United States Patent [19]

Kuhlman et al.

[11] Patent Number: 4,999,465

[45] Date of Patent: Mar. 12, 1991

[54] LIGHT SWITCH PLATE COVER

[76] Inventors: Marvin G. Kuhlman, 446 Cambridge, Des Plaines, Ill. 60016; Gerald R. Sorensen, 845 Brook St., Elgin, Ill. 60120; Raymond J. Gradecki, 264 Lincoln, Mundelein, Ill. 60060

[21] Appl. No.: 576,376

[22] Filed: Aug. 31, 1990

[51] Int. Cl.[5] ..... H01H 9/16

[52] U.S. Cl. ..... 200/308; 40/491; 8/350

[58] Field of Search ..... 200/308, 309, 329, 330, 200/331; 40/490, 491; 116/281, 283; D8/350, 351, 352, 353; D13/177; 74/544

[56] References Cited

U.S. PATENT DOCUMENTS

| | | | |
|---|---|---|---|
| 2,354,224 | 7/1944 | Stein | 200/331 X |
| 2,668,456 | 2/1954 | Meistrell | 200/331 X |
| 3,004,128 | 10/1961 | Mikolajeski | 200/331 |
| 3,077,789 | 2/1963 | DeLashmutt | 200/331 X |
| 3,825,710 | 7/1974 | Roberts et al. | 200/331 |
| 3,839,615 | 10/1974 | Bradford | 200/331 |
| 4,697,364 | 10/1987 | Dean | 40/491 X |

*Primary Examiner*—Henry J. Recla
*Assistant Examiner*—Glenn T. Barrett
*Attorney, Agent, or Firm*—Wallenstein, Wagner & Hattis, Ltd.

[57] ABSTRACT

A switch plate cover for a wall switch having a switch actuator is disclosed. The cover comprises a generally elongated panel folded substantially about a transverse fold line to form an outer member and an adjacent, inner member. The outer member includes a graphic representation having an aperture extending through the outer member. The cover further comprises a slot disposed along the fold line. A slide is disposed between the outer and inner members and extends through the slot. The slide includes a tongue extending outwardly through the slot. The tongue includes an opening for receiving the switch actuator. The slide moves between first and second positions in response to actuation of the switch between respective on and off switch positions. The slide further includes a first graphic indicia aligned with the aperture when the slide is in one of the first or second positions. For example, the graphic representation may be of an animated face, the aperture may be located at a location of a mouth of the animated face and the first graphic indicia may be of a smiling mouth, such that the smiling mouth is displayed through the aperture when the switch is shut off, thus encouraging the shutting off of the swtich.

16 Claims, 1 Drawing Sheet

LIGHT SWITCH PLATE COVER

DESCRIPTION

1. Technical Field

The invention relates to covers for wall mounted light switch plates and, more particularly, to an easily applied cover having an animated character which indicates the position of the switch.

2. Background Prior Art

Switch plate covers for wall mounted light, or room outlet, switches are typically covered with rather bland switch plate covers. Such bland switch plate covers, and hence the light or room outlet controlled by the particular switch, are often ignored. This can result in lights or other appliances being left on when not needed, resulting in a tremendous waste of energy.

The present invention is provided to solve these and other problems.

SUMMARY OF THE INVENTION

It is an object of the invention to provide a switch plate cover for a wall switch having a switch actuator.

In accordance with the invention, the cover comprises a generally elongated panel. The panel is folded substantially about a transverse fold line to form an outer member and an adjacent, inner member. The outer member includes a graphic representation having an aperture.

The cover further comprises a slot disposed along the fold line and a slide disposed between the outer and inner members and extending through the slot. The slide includes a tongue extending outwardly through the slot. The tongue includes an opening for receiving the switch actuator. The slide moves between first and second positions in response to actuation of the switch between respective on and off switch positions. The slide further includes a first graphic indicia aligned with the aperture when the slide is in one of the first or second positions.

For example, the graphic representation may be of an animated face, the aperture may be located at a location of a mouth on the animated face and the first graphic indicia may be of a smiling mouth, such that the smiling mouth indicia is displayed through the aperture when the switch is shut off, thus encouraging the shutting off of the switch.

Similarly, the animated face may have a plurality of apertures, such as corresponding to the location of a mouth and a pair of eyes. Accordingly, the slide may include corresponding graphic indicia comprising the mouth and the pair of eyes.

The cover further includes means such as an adhesive tape disposed on the inner member for securing the cover to the switch plate.

The cover still further includes a tab disposed on the inner member and a tab receiving slot disposed on the outer members distal to the fold line for securing the outer member to the inner member.

Other features and advantages of the invention will be apparent from the following specification taken in conjunction with the following drawing.

DETAILED DESCRIPTION

Figure 1:
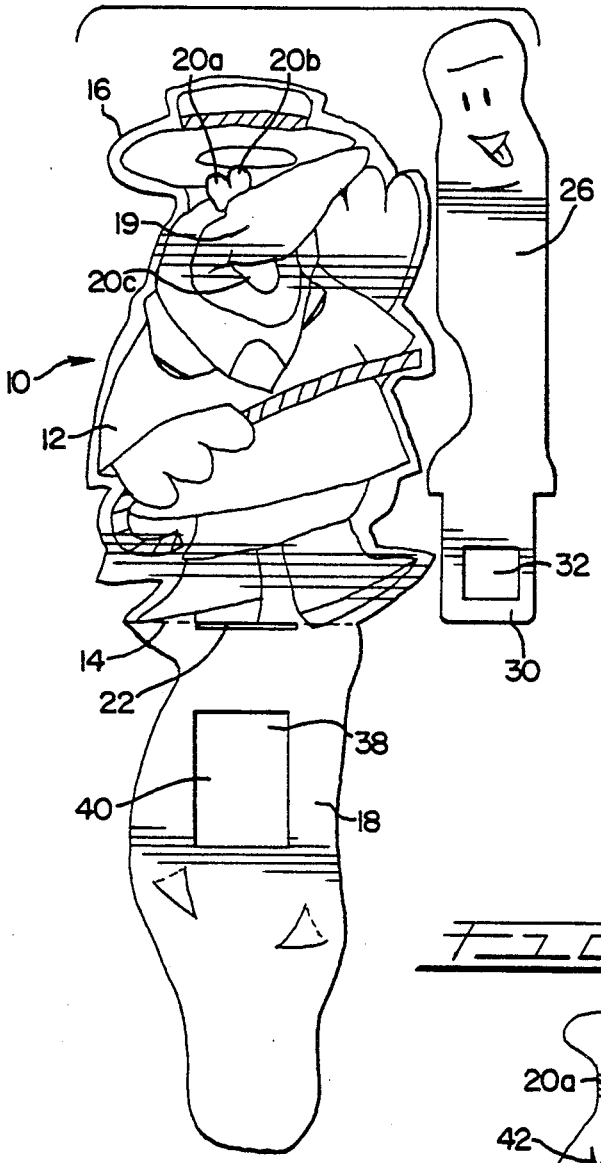
FIG. 1 is a plan view of one embodiment of the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A switch plate cover 10 adapted for covering a wall switch 11 (FIG. 3) is illustrated in FIG. 1. The cover 10 comprises a generally elongated panel 12 folded substantially about a transverse fold line 14 to form an outer member 16 and an adjacent, inner member 18. The outer member 16 includes a graphic representation of a character 19 having apertures 20*a, b,* and *c,* extending through the outer member 16.

The cover 10 further includes a slot 22 disposed along the fold line 14. A slide 26 is disposed between the outer and inner members 16,18, and extends through the slot 22.

The slide 26 includes a tongue 30 extending outwardly through the slot 22. The tongue includes an opening 32 for receiving a switch actuator 34 of the wall switch 11. The slide 26 moves between first and second positions in response to movement of the switch actuator 34 between respective on and off switch positions.

Figure 3:
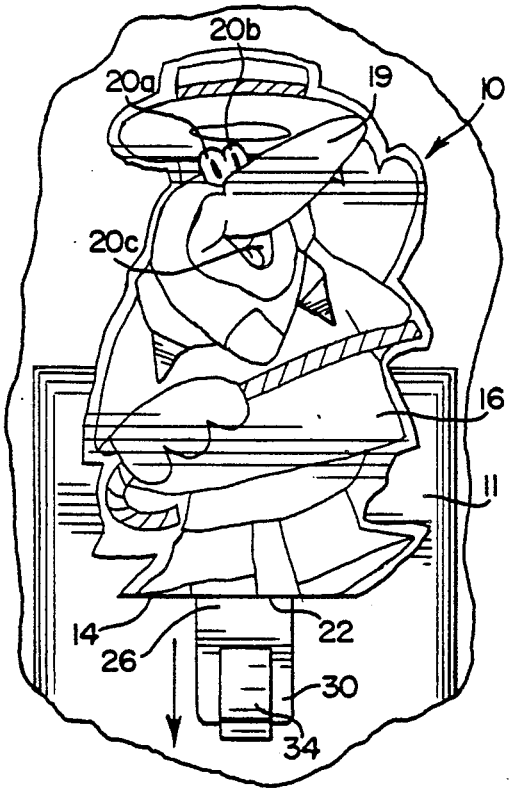
FIG. 3 is an additional view of the embodiment of FIG. 1.

Referring to FIG. 3, the slide 26 further includes graphic indicia 38*a, b, c,* aligned with respective ones of the apertures 20*a, b, c,* when the slide 26 is in the off switch position.

In the embodiment disclosed herein, the graphic representation 19 is of an animated face and the apertures 20*a, b, c* are located at locations of eyes and a mouth. Accordingly, the graphic indicia are of smiling eyes 38,*a b* and a mouth 38*c,* which are displayed through the apertures 20*a, b, c,* when the switch is shut off, thus encouraging the shutting off of the switch.

Referring again to FIG. 1, the cover 10 further includes an adhesive tape 38 disposed on the inner member 18 for securing the cover 10 to the switch plate. The adhesive tape 38 includes a backing 40 which is removed prior to use.

Figure 2:
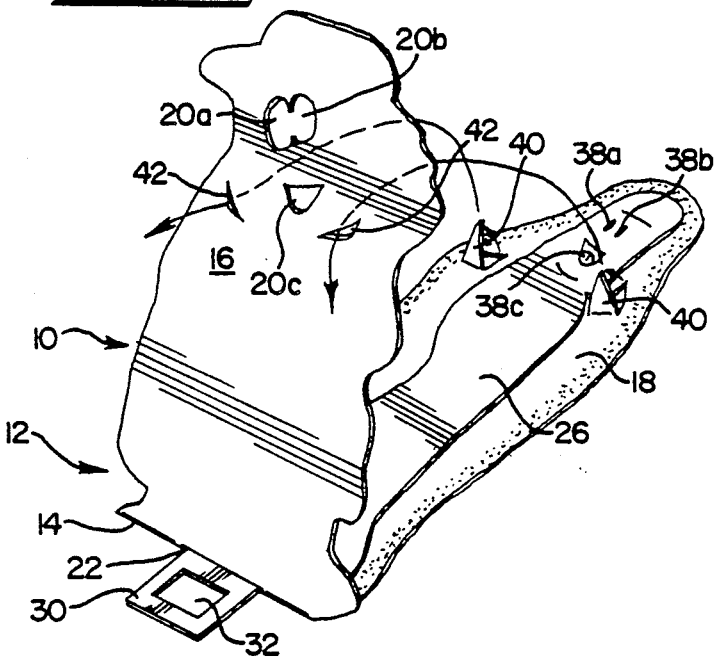
FIG. 2 is a view of the embodiment of FIG. 1 mounted on a switch plate.

Referring to FIG. 2, the cover 10 includes a pair of tabs 40 disposed on the inner member 18 and a corresponding pair of tab receiving slots 42 extending through the outer member 16 distal to the fold line 14 for securing the outer member 16 to the inner member 18.

The cover 10 mounted on a switch plate 50 with the switch in the off position is illustrated in FIG. 3. When the switch actuator is switched to the off position, the eyes and the mouth on the slide align with the apertures of the outer member 16.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

We claim:

1. A switch plate cover for a wall switch having a switch actuator, said cover comprising:

a generally elongated panel, said panel folded substantially about a transverse fold line to form an outer member and an adjacent, inner member, said outer member including a graphic representation having an aperture through said outer member;

a slot disposed along said fold line;

a slide disposed between said outer and inner members, said slide including a tongue extending outwardly through said slot, said tongue including means for receiving said switch actuator and sliding between first and second positions in response to actuation of said switch between respective on and off positions; said slide further including first graphic indicia aligned with said aperture when said slide is in one of said first or second positions.

2. The cover of claim 1 including second graphic indicia aligned with said aperture when said slide is in the other of said first or second positions.

3. The cover of claim 1 wherein said switch receiving means comprises an opening extending through said tongue.

4. The cover of claim 1 wherein said graphic representation has a plurality of apertures and said slide includes a corresponding plurality of first graphic indicia aligned with said plurality of apertures when said slide is in one of said first or second positions.

5. The cover of claim 1 wherein:

said graphic representation includes an animated face;

said plurality of apertures correspond to locations of eyes and a mouth on said face; and said graphic indicia include corresponding eyes and a mouth.

6. The cover of claim 1 including means adapted for securing said cover to said switch plate.

7. The cover of claim 6 wherein said securing means comprises an adhesive.

8. The cover of claim 1 including means distal to said fold line for attaching said outer member to said inner member.

9. The cover of claim 8 wherein said securing means comprises a tab disposed on one of said inner or outer members and a tab receiving slot disposed on said other of said inner or outer members.

10. A switch plate cover for a wall switch having a switch actuator, said cover comprising:

a generally elongated panel folded substantially about a transverse fold line and defining a vertical outer member and an adjacent, vertical inner member, said outer member including a graphic representation of an animated face and further including an aperture through said outer member at a selected facial feature of said face;

a substantially horizontal slot disposed along said fold line; and a slide disposed between said outer and inner members and including a tongue extending downwardly through said slot, said tongue including an opening for receiving said switch actuator and sliding between first and second positions in response to actuation of said switch, said slide further including graphic indicia of said selected facial feature aligned with said aperture when said slide is in one of said first or second positions.

11. The cover of claim 10 wherein said selected facial feature comprises a mouth.

12. The cover of claim 10 wherein said selected facial feature comprises eyes.

13. The cover of claim 10 including means adapted for securing said cover to said switch plate.

14. The cover of claim 13 wherein said securing means comprises an adhesive.

15. The cover of claim 10 including means distal to said fold line for securing said outer member to said inner member.

16. The cover of claim 15 wherein said securing means comprises a tab disposed on one of said inner or outer members and a tab receiving slot disposed on said other of said inner or outer members.

* * * * *

UNITED STATES PATENT AND TRADEMARK OFFICE

CERTIFICATE OF CORRECTION

PATENT NO. : 4,999,465

DATED : March 12, 1991

INVENTOR(S) : Marvin G. Kuhlman, Gerald R. Sorensen and Raymond J. Gradecki

It is certified that error appears in the above-identified patent and that said Letters Patent is hereby corrected as shown below:

On the title page, insert the following:

-- [73] Assignee: NCM INTERNATIONAL, INC., Arlington Heights, Illionois --.

Signed and Sealed this

Eleventh Day of August, 1992

*Attest:*

DOUGLAS B. COMER

*Attesting Officer*

*Acting Commissioner of Patents and Trademarks*